US007960664B2

(12) United States Patent
Inoue et al.

(10) Patent No.: US 7,960,664 B2
(45) Date of Patent: Jun. 14, 2011

(54) SEESAW SWITCH

(75) Inventors: Masatomo Inoue, Yokkaichi (JP); Yasushi Oonishi, Yokkaichi (JP); Nagatoshi Takeda, Yokkaichi (JP); Satoshi Nakagaki, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 305 days.

(21) Appl. No.: 12/296,307

(22) PCT Filed: Oct. 18, 2007

(86) PCT No.: PCT/JP2007/070312

§ 371 (c)(1),
(2), (4) Date: Oct. 7, 2008

(87) PCT Pub. No.: WO2008/068964

PCT Pub. Date: Jun. 12, 2008

(65) Prior Publication Data

US 2009/0255795 A1 Oct. 15, 2009

(30) Foreign Application Priority Data

Dec. 5, 2006 (JP) ..... 2006-328227

(51) Int. Cl.
*H01H 21/02* (2006.01)

(52) U.S. Cl. ..... 200/339

(58) Field of Classification Search ..... 200/5 R, 200/339, 517, 553, 557, 561
See application file for complete search history.

(56) References Cited

U.S. PATENT DOCUMENTS 3,862,388 A * 1/1975 Lusti et al. ..... 200/83 T
5,149,924 A * 9/1992 Priesemuth ..... 200/5 R
5,753,874 A * 5/1998 Kossakowski ..... 200/1 B
6,737,592 B1 * 5/2004 Hoang et al. ..... 200/1 B
7,067,752 B2 * 6/2006 Shin ..... 200/310
7,202,431 B2 * 4/2007 Gauzin ..... 200/339
7,285,740 B2 * 10/2007 Nakajima ..... 200/339
7,426,338 B2 * 9/2008 Matsumoto et al. ..... 396/25
2001/0027913 A1 10/2001 Sugata (Continued)

FOREIGN PATENT DOCUMENTS

JP 2001-14980 1/2001

(Continued)

OTHER PUBLICATIONS

English language Abstract of JP 2005-310413, Nov. 4, 2005.

(Continued)

*Primary Examiner* — Michael A Friedhofer
(74) *Attorney, Agent, or Firm* — Greenblum & Bernstein P.L.C.

(57) ABSTRACT

A purpose of the present invention is to provide a seesaw switch that has a simple structure with improved opearatability. In order to achieve the purpose, a seesaw switch 1 includes pressing sections each located at corresponding locations of operated sections of a pair of switch elements; a rotation operating member that is rotationally displaced; pressure transmitting members that are respectively provided between the pressing sections and operated sections; and a guide member that guides the pressure transmitting members to contacting and separating directions with respect to the operated sections, when the pressing sections are rotationally displaced. The seesaw switch also includes viscous material that is provided between the pressing sections and the pressure transmitting members. The viscous material has viscosity that allows inclination of the pressing sections toward the pressure transmitting members, while enabling the pressure transmitting members to follow the rotational displacement of the pressing sections.

8 Claims, 7 Drawing Sheets

U.S. PATENT DOCUMENTS

2001/0030115 A1 10/2001 Sugata

FOREIGN PATENT DOCUMENTS

| | | |
|---|---|---|
| JP | 2005-19347 | 1/2005 |
| JP | 2005-310413 | 11/2005 |
| JP | 2006-40562 | 2/2006 |

OTHER PUBLICATIONS

English language Abstract of JP 2005-19347, Jan. 20, 2005.
English language Abstract of JP 2001-14980, Jan. 19, 2001.
English language Abstract of JP 2006-40562, Feb. 9, 2006.

* cited by examiner

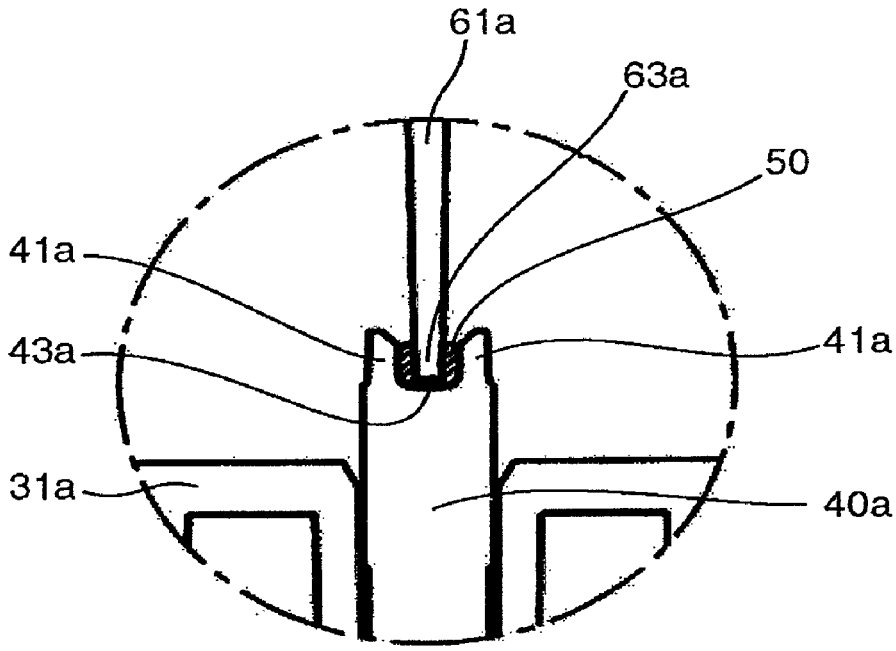
FIG.5
FIG.6 (a) (b)
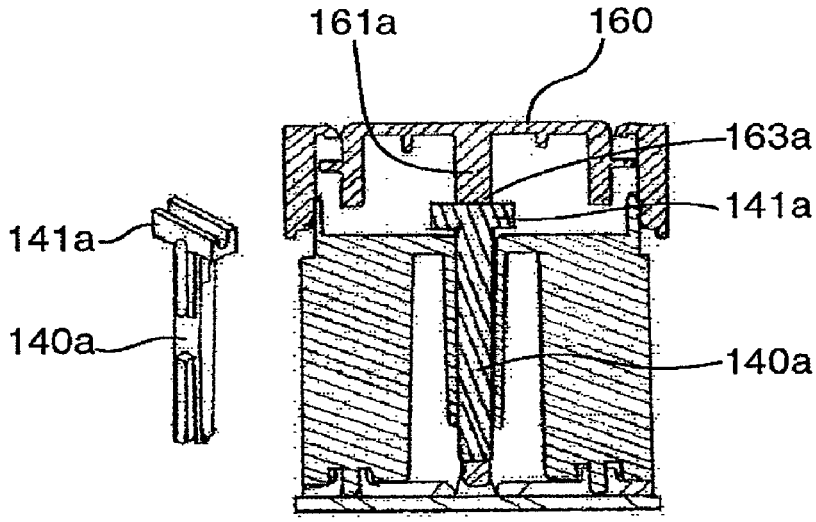

FIG.7 (a) (b)
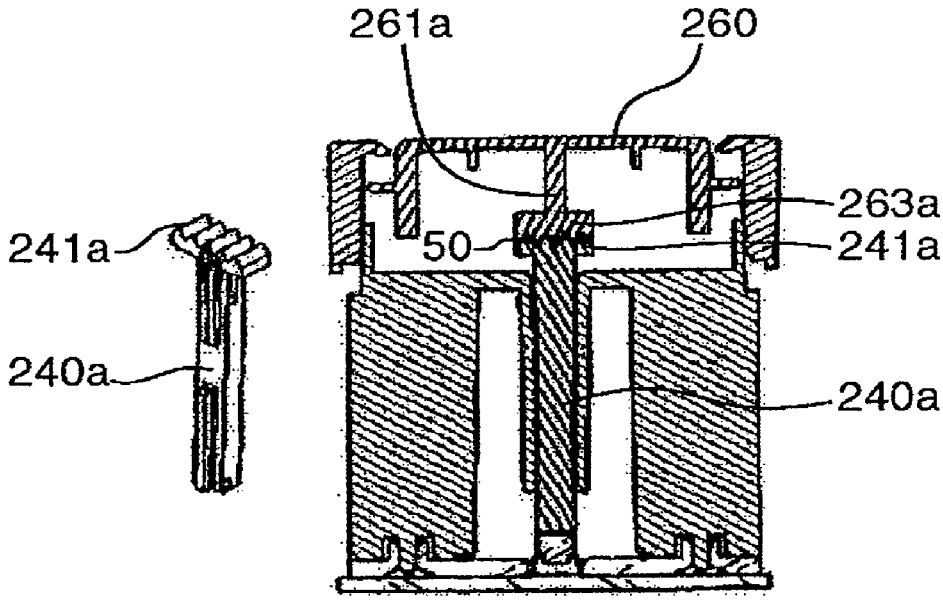
FIG.8 (a) (b)
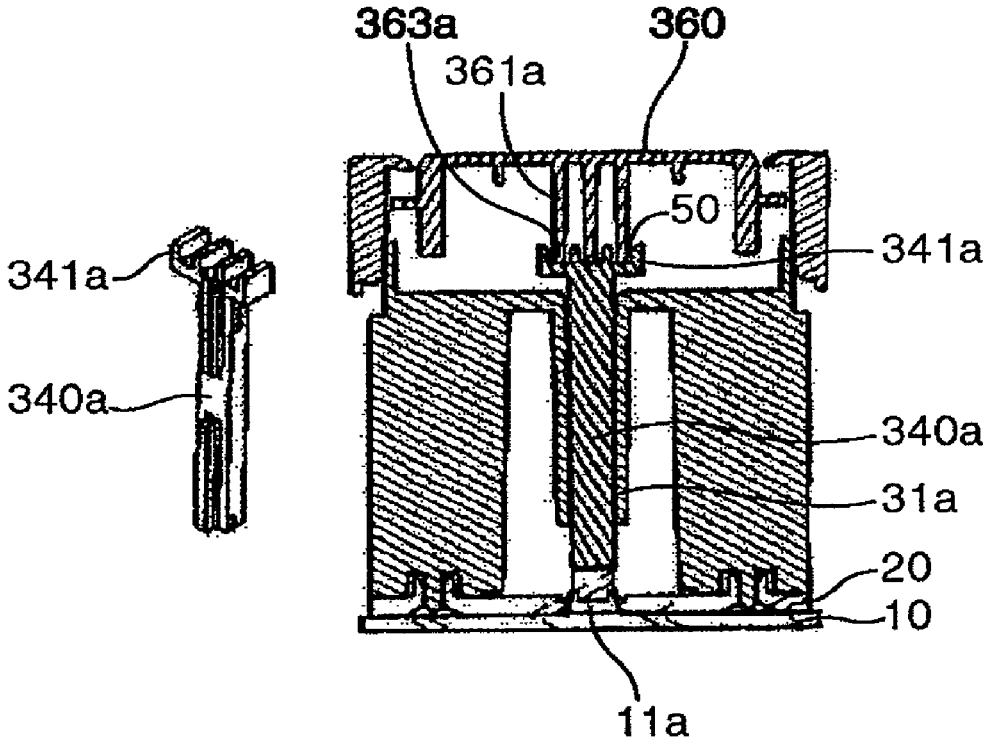

SEESAW SWITCH

BACKGROUND OF THE INVENTION

1. Field of the Invention

The present invention relates to a seesaw switch provided in a vehicle panel.

2. Description of Related Art

Seesaw switches are provided in vehicle panels such as instrument panels so as to provide various controls of audio and air conditioning devices. A conventional structure of such a seesaw panel is shown in schematic diagrams of FIGS. 9(*a*) and (*b*). A seesaw switch 500 includes, as shown in FIGS. 9(*a*) and (*b*), a pair of switch elements 512*a*, 512*b* provided on a substrate 510; an operating member 560 that presses and operates the switch elements 512*a*, 512*b*; and pressure transmitting members 540*a*, 540*b* provided between the operating member 560 and the switch elements 512*a*, 512*b*, respectively. The operating member 560 has pressing sections 560*a*, 560*b* provided at corresponding locations to the switch elements 512*a*, 512*b*, respectively. A rotating axis 560*c* is located between the pressing sections 560*a*, 560*b* and supports rotational displacement of the pressing sections pivoting around the rotating axis 560*c*. The pressure transmitting members 540*a*, 540*b* press the switch elements 512*a*, 512*b*, respectively, by displacement of the pressing sections 560*a*, 560*b* in a pressing direction as the operating member 560 rotates.

In the seesaw switch 500, the operating member 560 is pressed and operated. When the operating member 560 is rotationally displaced from a neutral position shown in FIG. 9(*a*) to another position shown in FIG. 9(*b*), the first pressing section 560*b* of the operating member 560 is displaced in a pressing direction along with the rotational displacement. Then, the pressure transmitting member 540*b* presses the switch element 512*b*. When the operation member 560 is rotationally displaced in the opposite direction from this pressing state, the operation member 560 moves back to the position shown in FIG. 9(*a*) and releases the pressing state of the switch element 512*b*.

With the above-mentioned seesaw switch 500, when the operation member 560 is rotatably displaced from the neutral position as shown in FIG. 9(*b*), the second pressing section 560*a* of the operation member 560 and the pressure transmitting member 540*a* are separated. Consequently, when the operation member 560 moves back to the neutral position, the pressing section 560*a* of the operation member 560 and the pressure transmitting member 540*a* collide with each other and generate a collision noise, which brings discomfort to the user and the like.

In order to address the problem, Related Art 1 discloses a seesaw switch that provides springs on the pressure transmitting members 540*a*, 540*b*, the springs constantly contacting on a rear surface the operation member 560 while being deformed elastically, and biasing, through their elasticity, the operation member in a direction opposite to the pressing direction.

With this seesaw switch, even when the operation member 560 is rotated from the neutral position and the first pressing section 560*b* of the operation member 560 is displaced in the pressing direction, the spring for the pressure transmitting member 540*a* is in contact with the rear surface of the second pressing section 560*a*. Therefore, even when the operation member 560 is moved back from this state to the neutral position, it is possible to suppress a sudden collision between the second pressing section 560*a* and the pressure transmitting member 540*a*, thereby suppressing the uncomfortable collision noise.

The above-described seesaw switch, however, requires a complex structure because of the springs installed to the respective pressure transmitting members 540. Further, the seesaw switch needs to be assembled while the springs are elastically deformed, which complicates the assembly.

In addition, with the above-described seesaw switch, the operation member 560 needs to be pressed while elastically deforming the springs against the biasing force of the springs. Therefore, an operation power greater than force to operate a non-seesaw switch including no spring is required, the non-seesaw switch being a push switch, for example, that does not need to include any spring due to absence of the collision noise. Then, the user may feel it is unnatural that variations of power are required for operating switches when the above-described seesaw switches and push switches and the like are located on one instrument panel, for example. Moreover, when springs are provided to the push switch and the like in order to equalize the operation power, even though they are not needed for the switch, the overall cost for the entire apparatus may become expensive.

[Related Art 1] Japanese Patent Laid-Open Publication 2006-40562

SUMMARY OF THE INVENTION

A purpose of the present invention is to provide a seesaw switch that has a simple structure with improved opearatability.

In order to achieve the above-described purpose, the present invention provides a seesaw switch having: a pair of switch elements each of which has an operated section that receives a pressing operation; a rotation operating member that has pressing sections at respective locations corresponding to the operated sections of the switch elements, and is rotationally displaced pivoting around a rotating axis located between the pressing sections; pressure transmitting members each of which is located between each of the pressing sections of the rotation operating member and the corresponding operated section of the switch element, and transmits pressure from the pressing section of the rotation operating member to the operated section of the switch element; a guide member that guides the pressure transmitting member to be displaced in contacting and separating directions with respect to the operated section of the switch element, according to a rotational displacement of the rotation operating member, and to press the operated section of the switch element; and viscous material that is provided between each of the pressing sections of the rotation operating member and the pressure transmitting member corresponding to the pressing section, and affixes the pressure transmitting member to the pressing section of the rotation operating member. The viscous material has sufficient viscosity that allows the pressing section of the rotation operating member to incline toward the pressure transmitting member, while enabling the pressure transmitting member to follow a rotational displacement of the pressing section.

According to the seesaw switch of the present invention, it is possible to suppress a separation between the rotation operating member and the pressure transmitting member by a simple configuration where the viscous material is provided between each of the pressing sections of the rotation operating member and the pressure transmitting member. Therefore, it is possible to suppress the collision between the rotation operating member and the pressure transmitting member, thereby suppressing the collision noise. Further, the seesaw switch according to the present invention minimizes counter force exerted on the rotation operating member, when the rotation operating member is pressed. Therefore, it is possible to bring the opearatability of the seesaw switch close to the opearatability of other push switches and the like. Accordingly, it is possible to improve an overall opearatability, when the seesaw switch and other push switches and the like are provided on an instrument panel and the like of a vehicle.

BRIEF DESCRIPTION OF THE DRAWINGS

FIG. 3(*b*) is a cross sectional view of the seesaw switch shown in FIG. 1, the switch being in a neutral state;

FIG. 3(*c*) is a cross sectional view of the seesaw switch shown in FIG. 1, the switch being pressed at a second side;

FIG. 4(*b*) is cross sectional view of the seesaw switch shown in FIG. 1, the switch being in the neutral state;

FIG. 5 is a partially enlarged cross sectional view of the seesaw switch shown in FIG. 1;

FIG. 6(*a*) is a perspective view of a pushing member according to a second embodiment of the present invention;

FIG. 6(*b*) is a perspective view of a seesaw switch having the pushing member shown in FIG. 6(*a*) according to the second embodiment of the present invention;

FIG. 7(*a*) is a perspective view of a pushing member according to a third embodiment of the present invention;

FIG. 7(*b*) is a perspective view of a seesaw switch having the pushing member shown in FIG. 7(*a*) according to the third embodiment of the present invention;

FIG. 8(*a*) is a perspective view of a pushing member according to a fourth embodiment of the present invention;

FIG. 8(*b*) is a perspective view of a seesaw switch having the pushing member shown in FIG. 8(*a*) according to the fourth embodiment of the present invention;

FIG. 9(*b*) is a cross sectional view illustrating the seesaw switch shown in FIG. 9(*a*), the switch being in a neutral state.

DETAILED DESCRIPTION OF THE INVENTION

Figure 1:
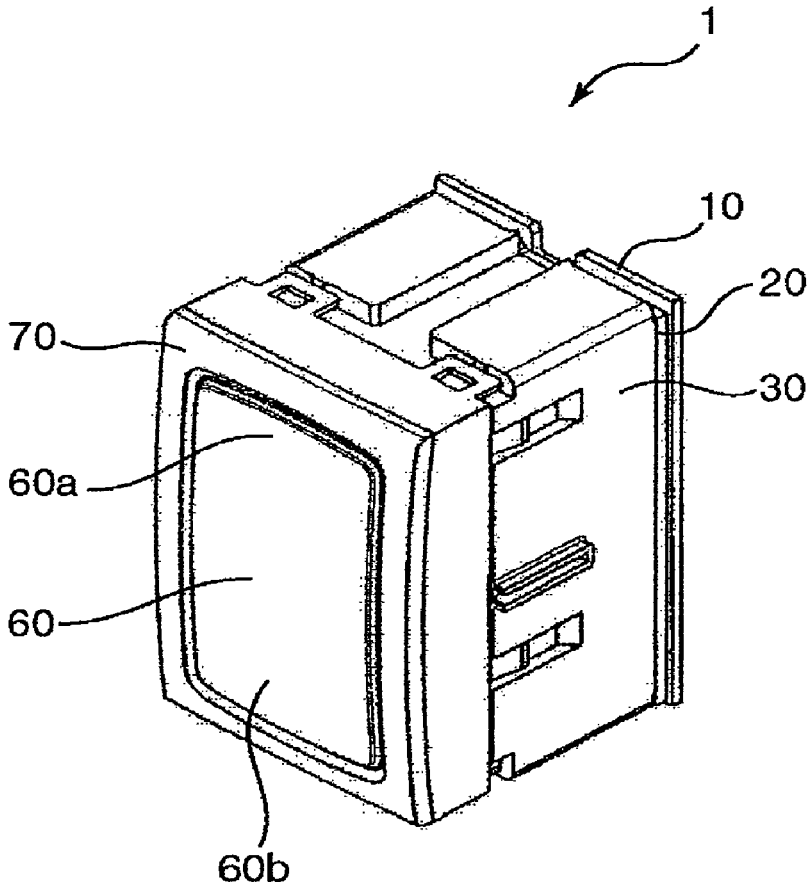
FIG. 1 is a perspective view of a seesaw switch according to a first embodiment of the present invention.
Figure 2:
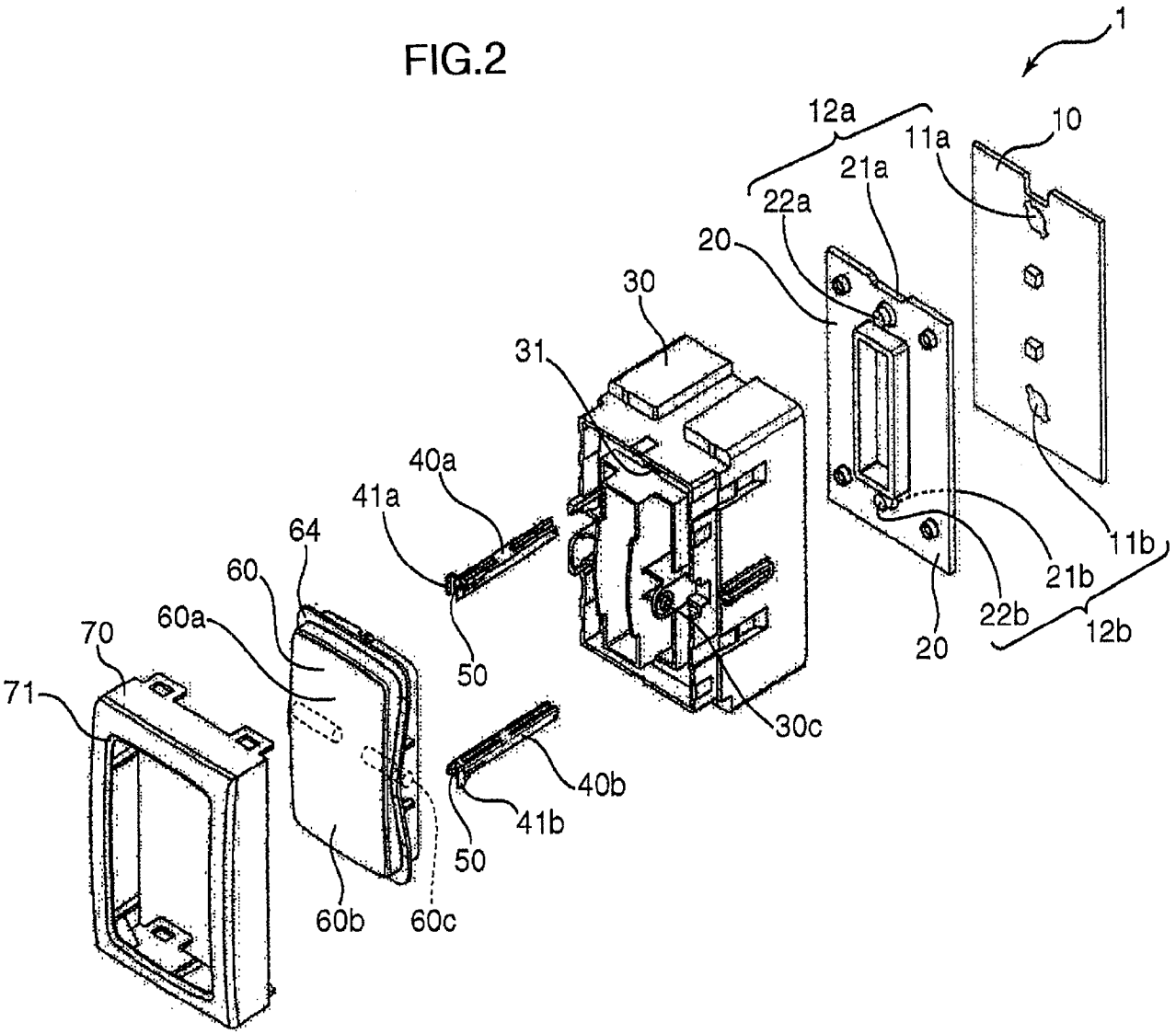
FIG. 2 is an exploded perspective view of the seesaw switch shown in FIG. 1.

The present invention is further described in the detailed description which follows, in reference to the drawings. FIG. 1 is a perspective view of a seesaw switch according to the present invention. FIG. 2 is an exploded perspective view of the seesaw switch.

As shown in FIGS. 1 and 2, a seesaw switch 1 includes a substrate 10, a rubber contact 2, a holder 30, a pair of pushing members (pressure transmitting members) 40*a*, 40*b*, grease (viscous material) 50, a knob (rotation operating member) 60, and a cover 70.

The substrate 10 is provided with a pair of opposing electrodes 11*a*, 11*b*. The rubber contact 20 is provided with externally protruding operated sections 22*a*, 22*b* at opposing locations of the opposing electrodes 11*a*, 11*b*, respectively. Rear surfaces of the operated sections 22*a*, 22*b* are affixed by contact points 21*a*, 21*b*. In the seesaw switch 1, a pair of switch elements 12*a*, 12*b* are configured with the pair of opposing electrodes 11*a*, 11*b*, operated sections 22*a*, 22*b*, and contact points 21*a*, 21*b*. In other words, the contact points 21*a*, 21*b* contact opposing electrodes 11*a*, 11*b*, respectively, when pushing members 40*a*, 40*b* (later described) press the operated sections 22*a*, 22*b* with a predetermined pressure. When the pressure from the pushing members 40*a*, 40*b* is released, the contact between the contact points 21*a*, 21*b* and the opposing electrodes 11*a*, 11*b* is released. When the contact points 21*a*, 21*b* contact the opposing electrodes 11*a*, 11*b*, respectively, the opposing electrodes 11*a*, 11*b* are conducted.

The knob 60 operates the switch elements 12*a*, 12*b* through the pushing members 40*a*, 40*b* (later described) and the like. The knob 60 includes pressing sections 61*a*, 61*b*, operating sections 60*a*, 60*b*, and a rotating axis 60*c*. The pressing sections 61*a*, 61*b* press the pushing members 40*a*, 40*b* (later described). The pressing sections 61*a*, 61*b* are located at corresponding locations to the operated sections 22*a*, 22*b* of the switch elements 12*a*, 12*b*, respectively, and protrude toward the operated sections 22*a*, 22*b*, respectively. The operating sections 60*a*, 60*b* are sections that can be pressed by the user and the like, and are respectively located at corresponding locations to the pressing sections 61*a*, 61*b*. The rotating axis 60*c* is held by an axis receiver 30*c* of a holder 30 (later described), and is located between the operating sections 60*a*, 60*b*. The knob 60 is held by holder 30 so that, when the operating sections 60*a*, 60*b* are pressed, the knob 60 is rotationally displaced pivoting around the rotating axis 60*c*. In other words, when a first operating section 60*a* is pressed, for example, the knob 60 is rotationally displaced from the neutral state shown in FIG. 4(*b*) to a state shown in FIG. 4(*a*).

Figure 3:
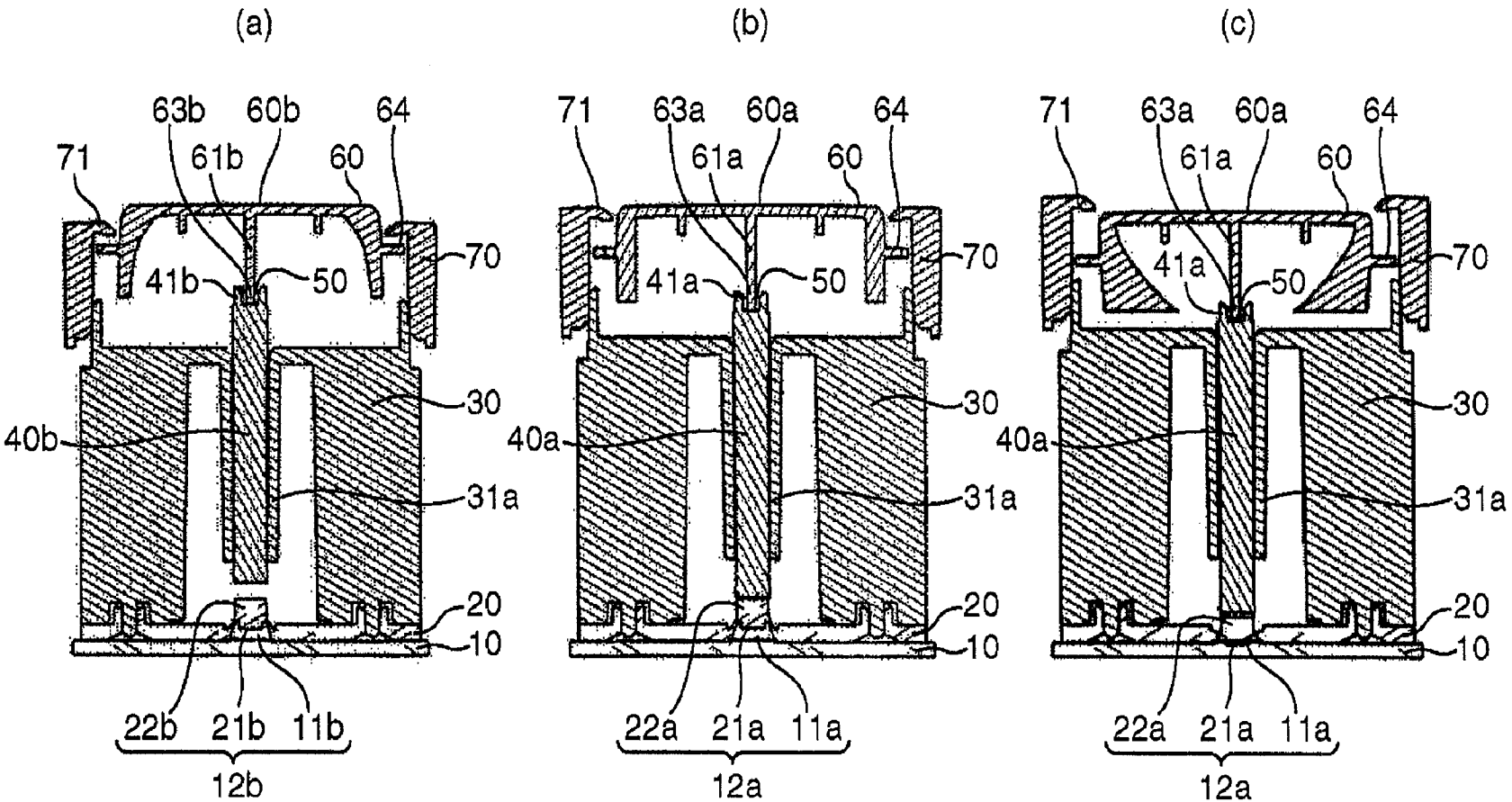
FIG. 3(*a*) is a cross sectional view of the seesaw switch shown in FIG. 1, the switch being pressed at a first side.
Figure 4:
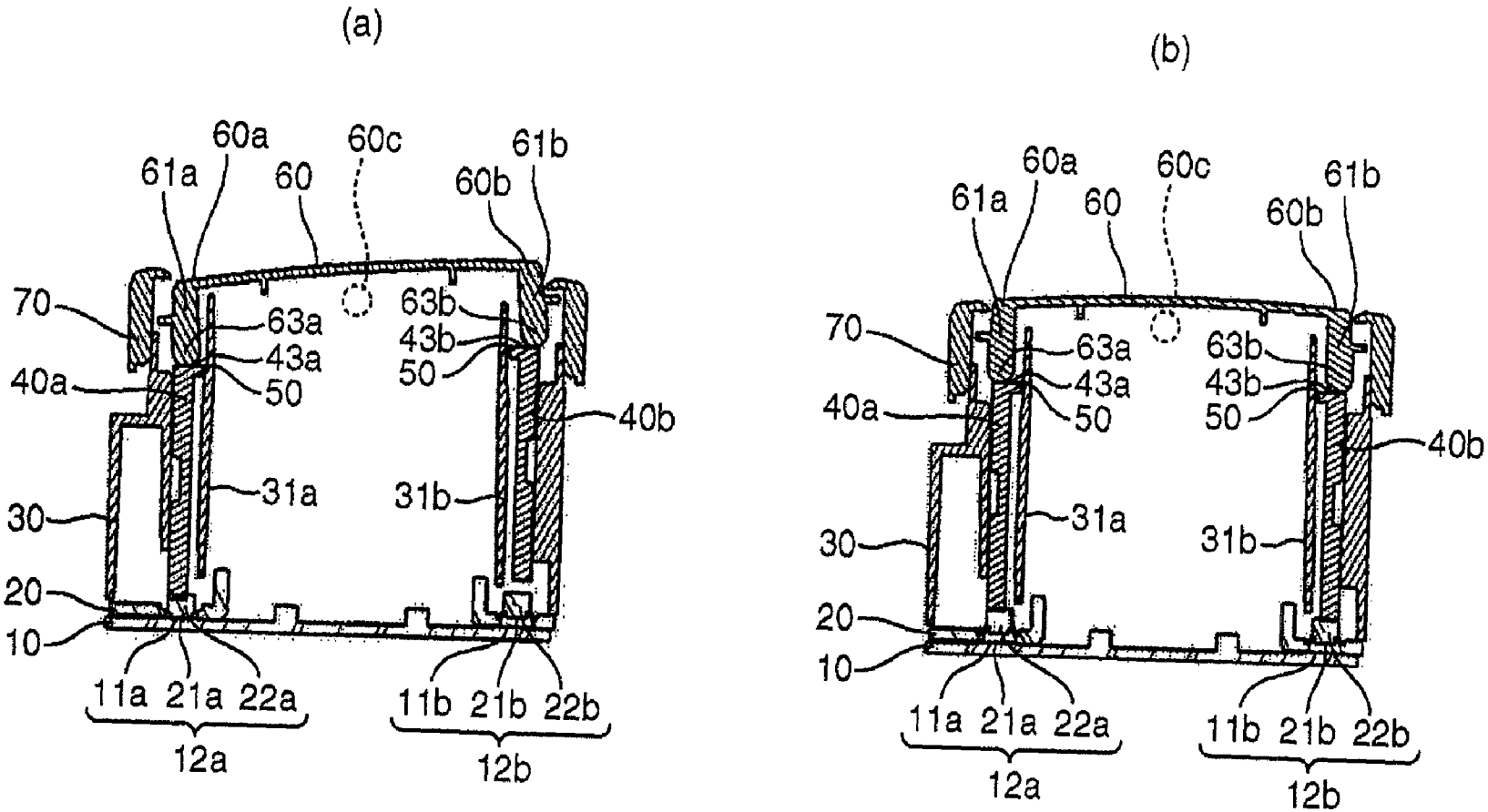
FIG. 4(*a*) is a cross sectional view of the seesaw switch shown in FIG. 1, the switch being pressed at the first side.
Figure 9:
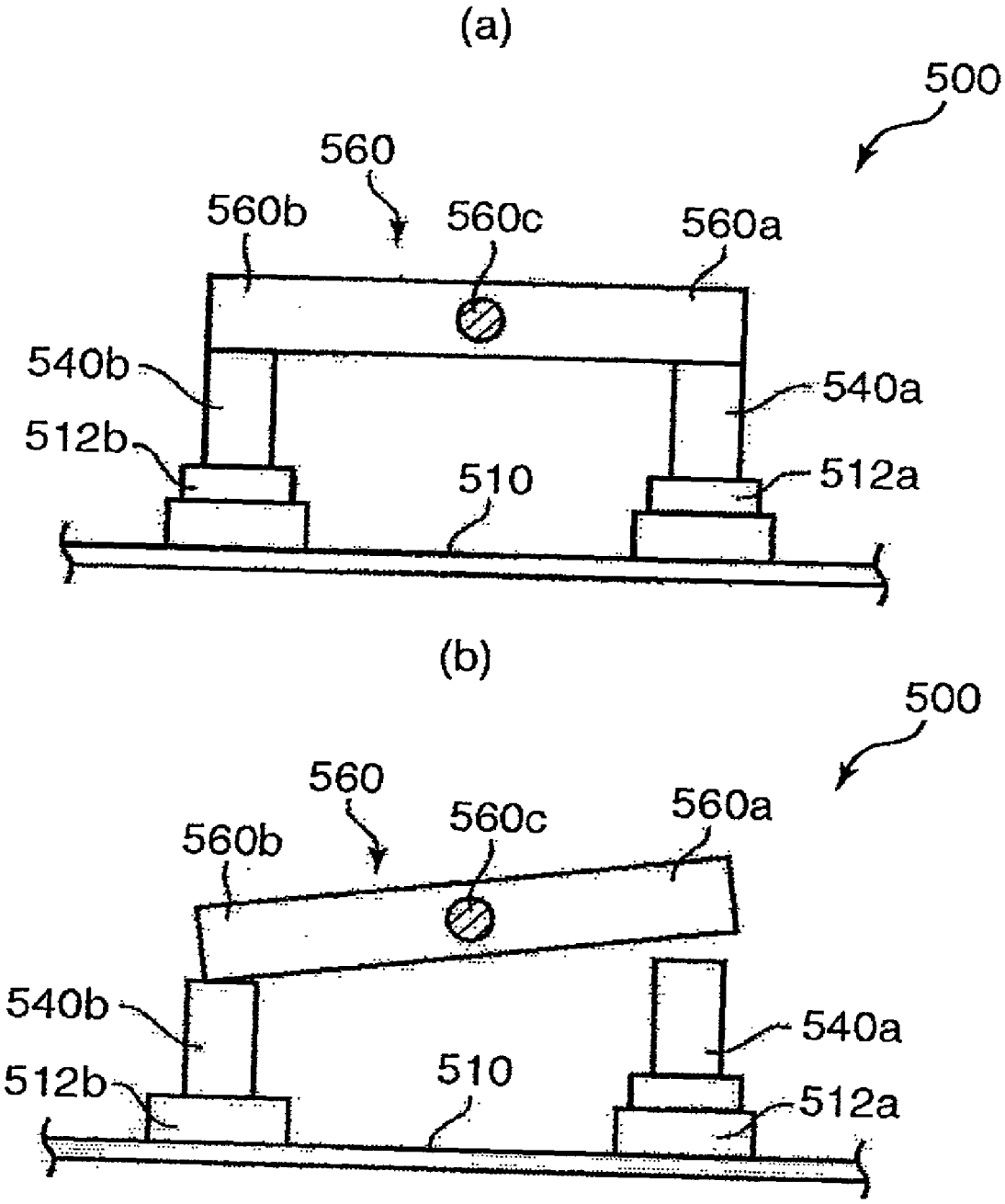
FIG. 9(*a*) is a cross sectional view illustrating a conventional seesaw switch in a pressed state.

At end portions of pressing sections 61*a*, 61*b* of the knob 60, boards 63*a*, 63*b* are provided, respectively, the boards having a board shape as shown in the cross sectional figures of FIG. 3(*a*) through FIG. 4(*b*). When the operating sections 60*a*, 60*b* are pressed and displaced proximate to the pushing members 40*a*, 40*b*, the boards 63*a*, 63*b* contact and press the pushing members 40*a*, 40*b*.

In addition, the knob 60 includes a rotation regulator 64 that protrudes externally toward a perimeter of the knob. The rotation regulator 64 regulates the rotational displacement of the knob 60 and prevents the rotational displacement of the knob 60 by more than a predetermined amount, by contacting a regulator 71 of a cover 70 (later described).

The pushing members 40*a*, 40*b* respectively transmit, to the operated sections 22*a*, 22*b*, pressure applied to the pressing sections 61*a*, 61*b* of the knob 60. The pushing members 40*a*, 40*b* are respectively provided between the pressing sections 61*a*, 61*b* of the knob 60 and the operated sections 22*a*, 22*b* of the switch elements 12*a*, 12*b*. Along with the rotational operation of the pressing sections 61*a*, 61*b*, the pushing members 40*a*, 40*b* are displaced in contacting and separating directions with respect to the operated sections 22*a*, 22*b* along guides 31*a*, 31*b* (later described) to press and operate operated sections 22*a*, 22*b*.

The pushing members 40*a*, 40*b* are provided with a pair of walls 41*a* and a pair of walls 41*b*, respectively, each pair of walls mutually opposing to each other and extending toward the knob 60. The walls 41*a*, 41*b* are aligned parallel to the rotating axis 60*c* of the knob 60. Further, boards 63*a*, 63*b* are located between the walls 41*a*, 41*a*, and 41*b*, 41*b*, respectively. Specifically, the board 63*a* of the knob 60 is located between the walls 41*a* provided for the pushing member 40*a* side, while the board 63*b* of the knob 60 is located between the walls 41*b* provided for the pushing member 40*b* side. The inner circumferential surfaces of the walls 41*a*, 41*a* and the both side surfaces of the board 63*a* are mutually opposing perpendicular to a displacement direction of the pushing member 40*a*. Similarly, the inner circumferential surfaces of the walls 41*b*, 41*b* and the both side surfaces of the board 63*b* are mutually opposing perpendicular to a displacement direction of the pushing member 40*b*.

Further, contacting surfaces 43*a*, 43*b* are respectively formed between the walls 41*a*, 41*b*, the surfaces being respectively capable of contacting bottom ends of the boards 63*a*, 63*b* of the knob 60. When the contact surfaces 43*a*, 43*b* contact the bottom ends of the boards 63*a*, 63*b*, pressure from the pressing sections 61*a*, 61*b* is transmitted to the pushing members 40*a*, 40*b*.

The grease 50 is viscous material that has a predetermined viscosity as described later. The grease 50, as shown in the exploded view of FIG. 5, is provided between the pressing sections 61*a*, 61*b* of the knob 60 and the pushing members 40*a*, 40*b*, respectively, so that pushing members 40*a*, 40*b* are affixed to the pressing sections 61*a*, 61*b*, respectively. Specifically, the grease 50 is provided between the both side surfaces of the boards 63*a*, 63*b* of the pressing sections 61*a*, 61*b* and the inner circumferential surfaces of the walls 41*a*, 41*b*, respectively, in order to affix, with a sufficient affixing area, the walls 41*a*, 41*b* to the boards 63*a*, 63*b*, respectively.

For the grease 50, material having a sufficient viscosity is used, so that, when the knob 60 is rotationally displaced to rotationally displace the pressing sections 61*a*, 61*b*, the grease allows the boards 63*a*, 63*b* to incline toward the walls 41*a*, 41*b*, respectively, while enabling the pushing members 40*a*, 40*b* to follow the rotational displacement of the pressing sections 61*a*, 61*b*, respectively. In other words, the grease 50 shifts and deforms when the boards 63*a*, 63*b* incline toward the walls 41*a*, 41*b*, so that the inclination of the boards 63*a*, 63*b* is performed smoothly.

When the pressing sections 61*a*, 61*b* are displaced in a direction separating from the operated sections 22*a*, 22*b*, the grease 50 displaces the walls 41*a*, 41*b* in a direction separating from the operated sections 22*a*, 22*b* while being affixed to the boards 63*a*, 63*b*, due to interfacial resistance generated on the boards 63*a*, 63*b* and the walls 41*a*, 41*b*. Especially, in the present embodiment, the walls 41*a*, 41*b* and the boards 63*a*, 63*b* are opposing perpendicular to the displacement direction of the pushing members 40*a*, 40*b*, respectively, and force in a shearing direction is applied to the grease 50. Therefore, by effectively utilizing shearing resistance of the grease 50, the walls 41*a*, 41*b* can securely follow the boards 63*a*, 63*b*.

In this example, the viscous material provided between the pressing sections 61*a*, 61*b* and the pushing members 40*a*, 40*b* is not limited to the grease 50, as long as the material can allows the inclination of the boards 63*a*, 63*b* against the walls 41*a*, 41*b*, respectively according to the rotational displacement of the pressing sections 61*a*, 61*b* and enables the pushing members 40*a*, 40*b* to follow the rotational displacement of the pressing sections 61*a*, 61*b*, respectively, when the knob 60 is rotationally displaced as described above. The grease 50, however, is relatively inexpensive and maintains a predetermined viscosity for a long period of time. Thus, when the grease 50 is used as the viscous material, it is possible to reduce cost while securing the adhesion of the pressing sections 61*a*, 61*b* and the pushing members 40*a*, 40*b*.

The holder 30 retains the pair of pushing members 40*a*, 40*b* and the knob 60. The holder 30 is provided with an axis receiver 30*c* that holds the rotating axis 60*c* of the knob 60. In the holder 30, the axis receiver 30*c* is fitted with the rotating axis 60*c* and the knob 60 is held rotationally movable pivoting around the rotating axis 60*c*. Further, the holder 30 is provided with guides (guide members) 31*a*, 31*b* that guide the pair of pushing members 40*a*, 40*b* in contacting and separating directions with respect to the operated sections 22*a*, 22*b* of the switch elements 12*a*, 12*b*. The guides 31*a*, 31*b* have an approximately cylindrical shape and extend from the operated sections 22*a*, 22*b* toward the knob 60. When the pushing members 40*a*, 40*b* are inserted into the guides 31*a*, 31*b*, they are guided to the contacting and separating directions with respect to the operated sections 22*a*, 22*b*.

The cover 70 protects the knob 60 while regulating the amount of the rotational displacement of the knob 60. The cover 70 covers the knob 60 from a front side and locks with the holder 30. As described above, the cover 70 is provided with the regulator 71 in order to regulate the rotational displacement of the knob 60. When the knob 60 is rotationally displaced by a predetermined amount, the regulator 71 contacts the rotation regulator 64 of the knob 60 and prevents the knob 60 from rotating further.

The following describes operations of the seesaw switch 1.

When the operating sections 60*a*, 60*b* of the knob 60 are not operated, the knob 60 is retained at the neutral position shown in FIG. 3(*b*) and FIG. 4(*b*). In this position, the pushing members 40*a*, 40*b* have not received a pressure from the pressing sections 61*a*, 61*b* of the knob 60, thus the operated sections 22*a*, 22*b* of the switch elements 12*a*, 12*b*, respectively, are not operated. Specifically, the contact points 21*a*, 21*b* provided on the operated sections 22*a*, 22*b* are separated from the opposing electrodes 11*a*, 11*b* provided on the substrate 10, respectively, thus the opposing electrodes 11*a*, 11*b* are not conducted.

From this position, when the first operating section 60*a* of the knob 60 is pressed into a direction proximate to the switch element 12*a*, for example, the pressing section 61*a* that is located corresponding to the operating section 60*a* is rotationally displaced, as shown in FIG. 3(*c*). When the pressing section 61*a* is rotationally displaced, the board 63*a* provided on the pressing section 61*a* inclines between the walls 41*a* of the pushing member 40*a*, while shifting and deforming the grease 50, and is displaced into a direction proximate to the switch element 12*a*. In this example, the walls 41*a*, 41*a* are aligned parallel to the rotating axis 60*c* of the knob 60. Accordingly, even when the board 63*a* is inclined, it is possible to prevent the collision of the board 63*a* with the walls 41*a*, 41*a*. Thus, both the board 63*a* and the pressing section 61*a* are rotationally displaced in a preferable condition.

When the board 63*a* is displaced as described above, the lower end of the board 63*a* contacts the contacting surface 43*a* provided between the walls 41*a* of the pushing member 40*a*, and presses the pushing member 40*a*. When pressed, the pushing member 40*a* is displaced into a direction proximate to the switch element 12*a* along the guide 31*a* of the holder 30 as described above, and the lower end presses, through the pressing projection 22*a*, the operated section 22*a* of the switch element 12*a*. As described above, when the contact surface 43*a* provided between the walls 41*a* and the board 63 are contacted, the pressure applied to the pressing section 61*a* is transmitted to the operated section 22*a* of the switch element 12*a*. Therefore, the pressure is securely transmitted to the operated section 22*a*.

When the pressure applied to the operating section 60*a* of the knob 60 is transmitted to the operated section 22*a* through the pushing member 40*a*, the switch element 12*a* is pressed downward, and the contact point 21*a* contacts the opposing electrode 11*a*, thereby conducting the electrode 11*a*.

In the example, the grease 50 is only viscously deformed by the rotational displacement of the board 63*a*, and applies very little force against the rotational displacement to the board 63*a*. Therefore, the seesaw switch according to the present invention can be operated with much less force compared to the conventional seesaw switch in which a spring is provided between a rotation operating member (the operating section 60*a* of the knob 60) and a pressure transmitting member (the pushing member 40*a*), and the rotation operating member is operated against the biasing force of the spring.

As described above, when the operating section 60*a* is pressed into the direction proximate to the switch element 12*a*, the second pressing section 61*b* is rotationally displaced to the direction separating from the switch element 12*b*. Specifically, as shown in FIG. 3(*a*), the board 63*b* provided on the pressing section 61*b* inclines between the walls 41*b* while shifting and deforming the grease 50. The board 63*b* applies the shearing force to the grease 50 when being displaced to the direction separating from the switch element 12*b*. At this time, the walls 41*b* are affixed to the board 63*b* due to the shearing resistance of the grease 50 and are displaced to the direction separating from the switch element 12*b* along the guide 31*b*. In other words, the walls 41*b* and the board 63*b* stay together when being displaced to the direction separating from the switch element 12*b*. Therefore, even when the operating section 60*b* of the knob 60 is pressed and the knob 60 is moved back to the neutral position, it is possible to suppress collision between the contacting surface 43*b* of the walls 41*b* and the board 63*b*, thereby suppressing the collision noise from the collision.

According to the seesaw switch 1 of the present invention, the collision noise is suppressed by suppressing the collision between the knob 60 and the pushing members 40*a*, 40*b*. Therefore, by coordinating the opearatability of the seesaw switch 1 and of other push switches provided together with the seesaw switch 1, it is possible to improve an overall opearatability of the instrument panel and the like that includes the switches.

In this example, the configuration of the switch elements 12*a*, 12*b* is not limited to the above description. For example, a so-called tactile switch may be provided on the substrate 10 instead of the configuration of the above-described embodiment where the opposing electrodes 11*a*, 11*b* are provided on the substrate 10 and the rubber contact 20 is provided with the opposing electrodes 11*a* and 11*b* and the like.

In addition, the shapes of the pressing sections 61*a*, 61*b* and the pushing members 40*a*, 40*b* are not limited to the above description. For example, as shown in FIGS. 6(*a*) and (*b*), a configuration can be provided in which a pushing member 140*a* includes walls 141*a* aligned in a perpendicular direction with respect to a rotating axis of a knob 160, and a board member 163*a* is positioned between the walls 141*a*.

Further, as shown in FIGS. 7(*a*) and (*b*), a connecting section 263*a* and a connected section 241*a* may be provided, the connecting section 263*a* having a saw-tooth shape and being positioned at an end of the pressing section 261*a* of a knob 260, the connected section 241*a* being positioned on the pushing member 240*a* and having a shape that meshes with the connecting section 263*a*. Then, the grease 50 may be provided in the meshing area.

Additionally, as shown in FIGS. 8(*a*) and (*b*), a plurality of pressing sections 361*a* may extend from a knob 360, and boards 363*a* may be respectively provided to ends of the pressing sections 361*a*. Further, an end of pushing member 340*a* is provided with walls 341*a* having a plurality of board-like members extending such that the walls face side surfaces of the respective plurality of boards 363*a*. By providing the grease 50 between the plurality of the side surfaces of the boards 363*a* and side surfaces of the board-like members of the walls 341*a*, the contact surface between the grease 50 and the boards 363*a* and the walls 341*a* becomes large. Therefore, the pushing member 340*a* can securely follow the pressing sections 361*a*.

As described above, the present invention provides a seesaw switch having: a pair of switch elements each of which has an operated section that receives a pressing operation; a rotation operating member that has pressing sections at respective locations corresponding to the operated sections of the switch elements, and is rotationally displaced pivoting around a rotating axis located between the pressing sections; pressure transmitting members each of which is located between each of the pressing sections of the rotation operating member and the corresponding operated section of the switch element, and transmits pressure from the pressing section of the rotation operating member to the operated section of the switch element; a guide member that guides the pressure transmitting member to be displaced in contacting and separating directions with respect to the operated section of the switch element, according to a rotational displacement of the rotation operating member, and to press the operated section of the switch element; and viscous material that is provided between each of the pressing sections of the rotation operating member and the pressure transmitting member corresponding to the pressing section, and affixes the pressure transmitting member to the pressing section of the rotation operating member. The viscous material has sufficient viscosity that allows the pressing section of the rotation operating member to incline toward the pressure transmitting member, while enabling the pressure transmitting member to follow a rotational displacement of the pressing section.

With the above-described configuration, the viscous material provided between each of the pressing sections of the rotation operating member and the pressure transmitting member has viscosity that allows inclination of the pressing section of the rotation operating member toward the pressure transmitting member. Therefore, when the rotation operating member is rotationally displaced to the direction proximate to the switch element, the rotational displacement is converted to the displacement in the pressing direction to the switch element of the pressure transmitting member. Thus, it is possible to secure a preferable pressing opearatability of the switch element. In addition, the counter force against the pressing operation is small, in comparison to a conventional seesaw switch where biasing force of a spring member is applied in a direction opposite to the pressing direction. Therefore, it is possible to bring the opearatability of the seesaw switch close to the opearatability of other push switches and the like. Accordingly, it is possible to improve an overall opearatability, when the seesaw switch and other push switches and the like are provided on an instrument panel and the like.

Furthermore, the viscous material has sufficient viscosity that enables the pressure transmitting member to follow a rotational displacement of the pressing section. Thus, when the rotation operating member is rotationally displaced in the direction separating from the switch element, the pressure transmitting member follows the rotational displacement. Therefore, it is possible to prevent the separation between the rotation operating member and the pressure transmitting member. As a result, when the rotation operating member is pressed again, collision between the rotation operating member and the pressure transmitting member is prevented, thereby suppressing the collision noise generated from the collision. In other words, it is possible to suppress generation of the collision noise and improve the opearatability, by the simple configuration where the viscous material having the above-described viscosity is provided between each of the pressing sections of the rotation operating member and the pressure transmitting member and where the pressing section and the pressure transmitting member are affixed.

Further, it is preferable that each of the pressure transmitting members has a contacting section that contacts, at least when the rotation operating member is operated toward a side proximate to the pressure transmitting member, the pressing section of the rotation operating member of the operated side, and transmits the pressure to the operated section of the switch element. With this configuration, when the pressing section of the rotation operating member and the contacting section of the pressure transmitting member come in contact, pressure applied to the rotation operating member is applied to the operated section of the switch element. Therefore, it is possible to operate the switch element more securely.

In addition, it is preferable that both the pressure transmitting member and the pressing section of the rotation operating member have mutually opposing surfaces in a direction perpendicular to the displacement direction of the pressure transmitting member, and that the viscous material is provided between the mutually opposing surfaces. With this configuration, when the pressing section of the rotation operating member is displaced in the direction separating from the operated section, shearing force is applied to the viscous member, which is provided between the mutually opposing surfaces of the pressing section and the pressure transmitting member. By effectively utilizing the shearing resistance of the viscous member, it is possible to enable the pressure transmitting member to follow the rotational displacement of the pressing section more securely.

Additionally, it is preferable that one of the pressure transmitting member and the corresponding pressing section of the rotation operating member has walls that are aligned parallel to the rotating axis, and the other has a board placed between the walls, and that the viscous material is provided between both side surfaces of the board and inner circumferential surfaces of the walls. With this configuration, the both side surfaces of the board and the inner circumference surfaces of the walls are affixed by the viscosity. Therefore, the affixed surfaces of the pressure transmitting member and the rotation operating member are sufficiently secured, thereby enabling the pressure transmitting member to follow the rotational displacement of the pressing section more securely. Especially, since the walls are aligned parallel to the rotating axis and the board is positioned between the walls, the collision between the board and the walls is prevented when the rotation operating member is rotationally displaced. Accordingly, it is possible to secure the preferable rotational displacement of the rotation operating member.

Furthermore, it is preferable that one of the pressure transmitting member and the pressing section of the rotation operating member is capable of contacting the board between the walls, and has a contacting surface that transmits, through its contact, the pressure applied to the rotation operating member to the pressure transmitting member. With this configuration, the contact surface of the pressure transmitting member and the rotation operating member is sufficiently secured, while securely transmitting the pressure applied to the rotation operating member to the operated section of the switch element, thereby facilitating the secure operation.

What is claimed is:

1. A seesaw switch comprising:

a pair of switch elements each of which has an operated section that receives a pressing operation;

a rotation operating member that has pressing sections at respective locations corresponding to the operated sections of the switch elements, and is rotationally displaced pivoting around a rotating axis located between the pressing sections;

pressure transmitting members each of which is located between each of the pressing sections of the rotation operating member and the corresponding operated section of the switch element, and transmits pressure from the pressing section of the rotation operating member to the operated section of the switch element;

a guide member that guides the pressure transmitting member to be displaced in contacting and separating directions with respect to the operated section of the switch element, according to a rotational displacement of the rotation operating member, and to press the operated section of the switch element; and viscous material that is provided between each of the pressing sections of the rotation operating member and the pressure transmitting member corresponding to the pressing section, and affixes the pressure transmitting member to the pressing section of the rotation operating member, wherein the viscous material has sufficient viscosity that allows the pressing section of the rotation operating member to incline toward the pressure transmitting member, while enabling the pressure transmitting member to follow a rotational displacement of the pressing section.

2. The seesaw switch according to claim 1, wherein each of the pressure transmitting members has a contacting section that contacts, at least when the rotation operating member is operated toward a side proximate to the pressure transmitting member, the pressing section of the rotation operating member of the operated side, and transmits the pressure to the operated section of the switch element.

3. The seesaw switch according to claim 1, wherein both the pressure transmitting member and the pressing section of the rotation operating member have mutually opposing surfaces in a direction perpendicular to the displacement direction of the pressure transmitting member, and wherein the viscous material is provided between the mutually opposing surfaces.

4. The seesaw switch according to claim 3, wherein one of the pressure transmitting member and the corresponding pressing section of the rotation operating member has walls that are aligned parallel to the rotating axis, and the other has a board placed between the walls, and wherein the viscous material is provided between both side surfaces of the board and inner circumferential surfaces of the walls.

5. The seesaw switch according to claim 4, wherein one of the pressure transmitting member and the pressing section of the rotation operating member is capable of contacting the board between the walls, and has a contacting surface that transmits, through its contact, the pressure applied to the rotation operating member to the pressure transmitting member.

6. The seesaw switch according to claim 2, wherein both the pressure transmitting member and the pressing section of the rotation operating member have mutually opposing surfaces in a direction perpendicular to the displacement direction of the pressure transmitting member, and wherein the viscous material is provided between the mutually opposing surfaces.

7. The seesaw switch according to claim 6, wherein one of the pressure transmitting member and the corresponding pressing section of the rotation operating member has walls that are aligned parallel to the rotating axis, and the other has a board placed between the walls, and wherein the viscous material is provided between both side surfaces of the board and inner circumferential surfaces of the walls.

8. The seesaw switch according to claim 7, wherein one of the pressure transmitting member and the pressing section of the rotation operating member is capable of contacting the board between the walls, and has a contacting surface that transmits, through its contact, the pressure applied to the rotation operating member to the pressure transmitting member.

* * * * *